United States Patent [19]

Weisbach

[11] 4,411,404

[45] Oct. 25, 1983

[54] HOLDING CLIPS FOR STAKES SUPPORTING METAL CONCRETE FORMS

[75] Inventor: Albert P. Weisbach, Louisville, Ky.

[73] Assignee: Cardinal Manufacturing Co., Louisville, Ky.

[21] Appl. No.: 386,510

[22] Filed: Jun. 9, 1982

[51] Int. Cl.[3] ..... E01C 7/00

[52] U.S. Cl. ..... 249/3; 249/6

[58] Field of Search ..... 249/3, 4, 5, 6, 7, 208, 249/210, 207

[56] References Cited

U.S. PATENT DOCUMENTS

| | | | |
|---|---|---|---|
| 3,401,612 | 9/1968 | Tone | 249/3 |
| 3,770,237 | 11/1973 | Burton | 249/3 |
| 4,340,200 | 7/1982 | Stegmeier | 249/3 |

*Primary Examiner*—Donald E. Czaja

*Assistant Examiner*—James C. Housel

*Attorney, Agent, or Firm*—Richard L. Caslin

[57] ABSTRACT

A metal concrete joint form is shown supported on a plurality of spaced metal stakes. The top end of each stake is flattened. The concrete joint form is an elongated sheet metal member having an inverted hook portion at the top edge of the form for receiving the flattened top end of the stake. The main body of the stake has a semi-circular shape in transverse cross section. The invention is a separate holding clip that is made to straddle the main body of the stake and engages beneath the lower edge of the sheet metal form and is snapped into engagement with the stake for holding the sheet metal form against the stake while the concrete is being poured on either side of the form to form a monolithically poured concrete slab.

5 Claims, 5 Drawing Figures

HOLDING CLIPS FOR STAKES SUPPORTING METAL CONCRETE FORMS

BACKGROUND OF THE INVENTION

1. Field of the Invention

This invention relates to the art of concrete joint forms that are supported on a plurality of metal stakes to provide a key joint forming member between adjacent slab sections of a monolithically poured concrete slab.

2. Description of the Prior Art

The present invention relates to the use of a holding clip that is mounted on the metal stakes and engages the lower edge of the metal concrete joint form so that the concrete may be poured on either side of the metal form without displacing the metal form by the sheer weight or force of the moist concrete.

The Burton U.S. Pat. No. 3,770,237 describes a metal concrete form that is adapted to be supported on a plurality of spaced-apart, aligned stakes, where the stakes are provided with a pair of lanced tabs for engaging the lower edge of the sheet metal form. This design limits the vertical adjustability of the metal concrete form with respect to the supporting stake.

In the Burton U.S. Pat. No. 3,628,764, the vertical stake is provided with a transversely disposed tab portion for engagement into an elongated apperture that is formed in the metal concrete form, but this limits the vertical adjustability of the form with respect to the stake.

The Artigalas et al. U.S. Pat. No. 3,057,269 has a design similar to Burton U.S. Pat. No. 3,770,237 since it shows a stake having a lanced tab or lip for engaging under the lower edge of the divider strip.

The Self U.S. Pat. No. 3,561,721 shows a vertical stake provided with a plurality of vertically spaced openings positioned near the lower edge of the metal concrete form for receiving wire members, nails or the like for use at the butt joint between two adjacent lengths of metal concrete form so as to secure the stake to the lower portion of the form.

The Welch U.S. Pat. No. 3,497,172 describes a vertical stake having a plurality of vertically spaced openings, where one of such openings would receive a screw fastener that is threaded through an aligned opening in the metal concrete form to ensure against vertical movement of the form relative to the stake.

The Jarvis U.S. Pat. No. 778,583 shows a wooden concrete form for use in making concrete walls. Wooden planks are horizontally arranged and held in place by vertical posts which are fastened to the planks by means of hinged straps.

OBJECTS OF THE PRESENT INVENTION

The principal object of the present invention is to provide the combination of a metal concrete joint form that is supported on a plurality of vertical stakes with separate holding clips that engage between the stake and the bottom edge of the metal form to prevent a sidewise force of concrete being poured from swinging the lower edge portion of the form away from the stake.

A further object of the present invention is to provide an elongated metal concrete joint form assembly of the class described with separate holding clips that can be applied to the stake at any height thereon for use of any size concrete form whereby the clip is attached after the form is positioned onto the top of the stake; thereby eliminating the problem of aligning the top and bottom of the form at the same time.

A still further object of the present invention is to provide an elongated metal concrete joint form assembly of the class described with a separate holding clip, whereby the top edge of the form may be vertically adjusted with respect to the stake without changing the assembly method of the holding clip to the stake and to the bottom edge of the form.

SUMMARY OF THE INVENTION

The present invention provides an interlocking metal concrete joint form that is supported on a plurality of widely-spaced stakes for use in pouring concrete slabs. The concrete metal form is an elongated sheet metal member having a vertically-extending planar portion with an offset, protruding key portion adjacent its mid-height, and an inverted hook portion at the top of the form that is on the side that is opposite the protruding key portion. Each stake is a narrow, elongated member having a main body of semi-circular shape in transverse cross section. The top end of each stake is generally flattened, and this end is adapted to telescope within the inverted hook portion at the top of the form. The invention comprises a separate holding clip that is made to straddle the main body of the stake and engages beneath the lower edge of the sheet metal form. This clip is made to be fastened to the stake for holding the sheet metal form against the stake against sidewise displacement while the concrete is being poured; especially on the side that is opposite the protruding key portion of the metal form.

BRIEF DESCRIPTION OF THE DRAWINGS

This invention will be better understood from the following description taken in conjunction with the accompanying drawings, and its scope will be pointed out in the appended claims.

DESCRIPTION OF THE PREFERRED EMBODIMENT

Figure 1:
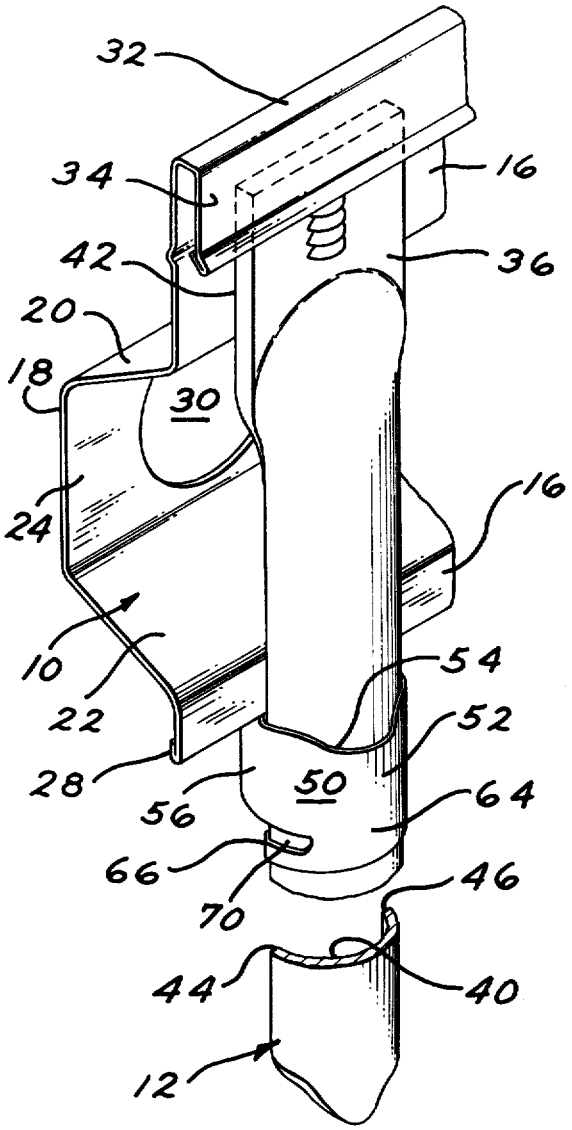
FIG. 1 is a fragmentary, perspective view of one end of a metal concrete joint form, along with a metal stake on which the form is adapted to be supported. Note the flattened top end of the stake, and the semi-circular shape in transverse cross section of the main body of the stake.

Turning now to a consideration of the drawings, and, in particular, to the fragmentary, perspective view of FIG. 1, there is shown a portion of the left end of a metal concrete joint form 10. This concrete joint form is an expendable, relatively rigid, elongated sheet metal form that is adapted to be supported on a plurality of vertical metal stakes 12. These forms generally come in standard lengths of 10 feet, and they are of various sizes in height; from about 3½ inches to about 9½ inches, depending on the desired thickness of the concrete slab. Non-removable metal concrete joint forms are used extensively in the construction field today, and they are suspended on these metal stakes which locate and level the form before the concrete is poured. One of the problems experienced with these products has been the possibility of the form being dislodged or displaced during the pouring of the concrete, and this possibility has been eliminated with the introduction of the present invention.

When the metal concrete joint form 10 is viewed in transverse cross section, as is seen in FIG. 1, it has a vertically-extending planar portion 16 with an offset, protruding key portion 18 adjacent its midheight. This key portion is a relatively large channel configuration that is set up on its side. This key portion has an upper side wall 20, a lower side wall 22, and a connecting base 24. The lower edge of the elongated concrete joint form 10 is rolled over to form a hem 28 to strengthen the rigidity of the form. The key portion 18 is shown with a hole 30, which would usually be closed by a "knockout." When this knockout is removed, the hole 30 is available for receiving electrical cables therethrough, or they may receive dowels or reinforcing rods or bars, as is well known in this art. Since these concrete joint forms 10 are adapted to be supported on a plurality of widely-spaced, vertical stakes 12, provision must be made on the form for accommodating the stakes. The top edge of the concrete joint form 10 has a horizontal flange 32 that extends outwardly from the planar portion 16 on the side that is opposite the key portion 18. This top flange 32 serves as a leveling guide for use with a screed that would extend across a pair of these parallel concrete forms 10 and thereby serve to level freshly-poured concrete as the screed (not shown) is drawn along the forms so as to smooth out the concrete surface. An inverted hook portion 34 is suspended down from the top flange 32 for mating engagement with the flattened top end 36 of the vertical metal stake 12.

Continuing to look at FIG. 1, the vertical metal stake 12 is a narrow, elongated, galvanized steel construction which has a main body of semi-circular shape in transverse cross section, as seen at 40 in FIG. 1. Notice that the top end of the stake 12 is flattened on the convex side of the stake so that the inner edge 42 is in the same vertical plane as the free ends 44 and 46 of the two vertical, parallel side edges of the semi-circular shape 40. Thus, the stake 12 is capable of bearing against the vertically-extending planar portion 16 of the concrete joint form 10 for a good bearing relationship between the two. The flattened top end 36 of the stake 12 is adapted to telescope into the inverted channel form that is created by the inverted hook portion 34 that extends downwardly from the horizontal flange 32. There are a variety of interlocking designs between vertical stakes and the concrete joint forms that are available on the market today. The present invention does not relate to this area of the design.

Figure 2:
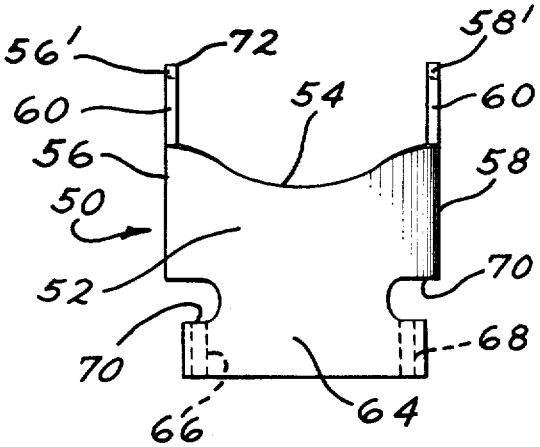
FIG. 2 is a front elevational view, on an enlarged scale, of the holding clip embodying the present invention.
Figure 3:
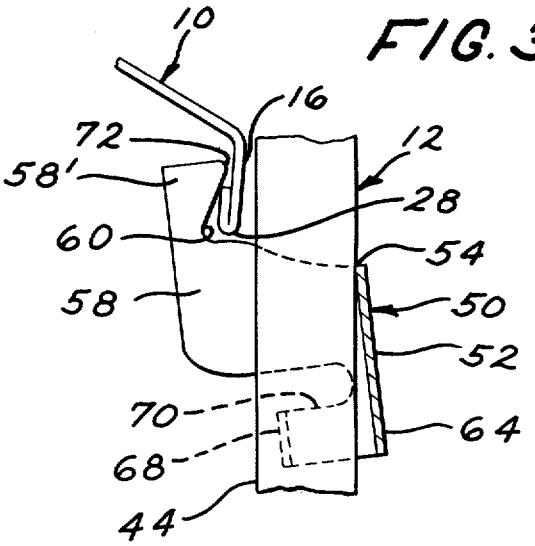
FIG. 3 is a fragmentary, left side elevational view showing the lower edge of the metal concrete form adjacent a vertical supporting stake, with a separate holding clip in its early stages of being applied under and behind the lower edge of the metal concrete form and just before it is forced into engagement with the opposite vertical edges of the stake.
Figure 4:
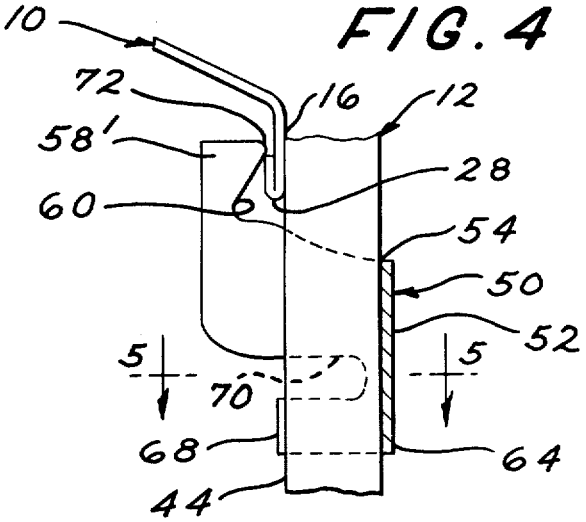
FIG. 4 is a fragmentary, left side elevational view, similar to that of FIG. 3, after the holding clip is forced into engagement with the opposite vertical sides of the main body of the stake, which is the normal operating position of the clip, as is seen in FIG. 1.
Figure 5:
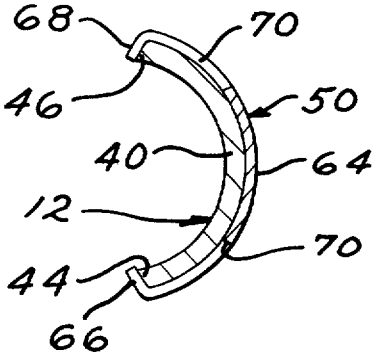
FIG. 5 is a cross-sectional plan view through the lower portion of the holding clip when it is fastened to the main body of the stake. This view is taken on the line 5—5 of FIG. 4.

The present invention relates to the solution to the problem that if the concrete is poured on the side of the form 10 which is opposite the protruding key portion 18, the pressure of the concrete would have a tendency to force the lower portion of the concrete joint form 10 to move away from the stake 12 and perhaps become dislodged or displaced from the stake altogether. The present invention relates to the provision of a separate holding clip 50, which is a small metal member that can be made to straddle the main body of the stake 12 and engage under and behind the lower edge 28 of the joint form 10. Then the clip may be forced into an assembled relationship with the stake for holding the sheet metal form against the stake at all times. The central body 52 of the clip 50 has a semi-circular shape in transverse cross section that conforms to the semi-circular shape 40 of the main body of the stake 12 when the clip is fastened to the stake, as is best seen in FIG. 5. The upper edge 54 of the central body 52 of the clip is formed with a concave recess 54, as is best seen in the front elevational view of FIG. 2. The central body 52 of the clip has two vertical sides 56 and 58 which extend upwardly into fingers 56' and 58' respectively. These upwardly-extending fingers 56' and 58' are adapted to engage under and behind the lower edge 28 of the sheet metal form 10, as is best seen in FIG. 3. Notice that each upwardly-extending finger 56' and 58' is formed with a tapered edge surface 60 to serve as a hook-like member for pulling in the lower edge of the sheet metal form 10 against the vertical side edges 44 and 46 of the stake 12, as is best seen in FIG. 4.

The lower portion 64 of the holding clip 50 also has a semi-circular shape having a pair of oppositely-directed ears 66 and 68, as is best seen in FIG. 5, which are adapted to snap into engagement with the opposite side edges 44 and 46 of the stake 12 for holding the clip on the stake. FIG. 3 is a preliminary assembly position, while FIG. 4 is a final holding position of the clip 50. Looking at FIG. 3, the clip 50 has been aligned with the stake with the concave, recessed edge 54 serving as a fulcrum edge working against the semi-circular shape 40 of the stake. At this early stage in the assembly, the lower edge 28 of the sheet metal form 10 may not be against the stake. Hence, this fulcrum 54 and the two fingers 56' and 58' serve to hook the lower edge 28 of the form so that when a pushing force is directed on the lower portion 64 of the clip, the two oppositely-directed ears 66 and 68 will snap around the vertical side edges 44 and 46 of the stake and be held in place. Notice that a horizontal notch 70 is formed in the vertical side edges of the lower portion 64 of the clip, just above each ear 66 and 68, in order to furnish each ear with spring resilience, as will be understood by those in this art.

Having described above a novel invention of the use of a separate holding clip for assembly on the vertical stake supporting a metal concrete form joint, it will readily be apparent to those skilled in this art that the use of this invention will withstand the pressure created by the concrete while it is being poured so as to prevent the form from being dislodged or displaced from its predetermined position. The distance between the concave, recessed edge 54 and the free end 72 of the upwardly-directed fingers 56' and 58' is greater than the combined thickness of the stake plus the lower edge of the form, as is measured in the final assembly view of FIG. 4, thereby allowing the holding clip 50 to be inserted freely, as seen in FIG. 3. Then, by adjusting the position of the clip, the clip assumes the final assembled position of FIG. 4. A small thumb pressure on the lower portion 64 of the clip causes the clip to rotate around the concave, recessed edge 54. As this rotation takes place, the lower edge 28 of the form is pulled against the stake and holds the two members tightly together. This holding clip 50 is only used when necessary; that is, when the pouring of the concrete is first made on the side of the form that is opposite the protruding key portion 18. This clip 50 could be left off if the pouring of the concrete were to be made on the side of the key portion 18 first. Secondly, the clip can be applied to any length stake, or to any height of sheet metal form 10, thereby eliminating the necessity for matched sets of stakes and form sizes. Thirdly, the clip 50 is attached after the form 10 is positioned onto the top of the stake 12; thereby eliminating the problem of aligning the top and bottom of the form 10 at the same time.

Modifications of this invention will occur to those skilled in this art. Therefore, it is to be understood that this invention is not limited to the particular embodiments disclosed, but that it is intended to cover all modifications which are within the true spirit and scope of this invention as claimed.

What is claimed is:

1. The combination of an interlocking metal concrete joint form supported on a plurality of vertical stakes for use in pouring concrete slabs, said combination comprising:

a. a plurality of expendable metal stakes, each stake being a narrow, elongated member having a main body of semi-circular shape in transverse cross section, the top end of each stake being generally flattened to create a generally straight edge on one side of the stake that includes the two vertical parallel sides of the semi-circular shape;

b. and an expendable, relatively rigid, elongated sheet metal form with a transverse cross section having a vertically extending planar portion with an offset protruding key portion adjacent its mid-height, and an inverted hook portion adjacent the top edge of the form on the side that is opposite the said protruding key portion, said hook portion having a downturned flange that is spaced away from the said vertical planar portion and adapted for engaging over the flattened upper end of the said vertical stakes;

c. the invention comprising a separate holding clip for each stake which is made to straddle the main body of the stake after the elongated form is supported on the spaced stakes, the clip having an upper portion with finger means that are adapted to engage the lower edge of the sheet metal form, on the side of the form opposite the stake and the clip having a lower portion with a pair of ear means that are able to snap around the opposite edges of the stake for fastening the lower portion of the sheet metal form against the stake.

2. The combination as is recited in claim 1, wherein the said holding clip also has a semi-circular shape in transverse cross section for conforming to the shape of the said main body of the stake, the upper edge of the clip having a concave recess, and the two vertical sides of the clip being formed to create two parallel, upwardly-extending fingers for engaging under the lower edge of the sheet metal form, on the side of the form opposite the stake while the lower edge of the clip is provided with a pair of oppositely-directed ears which are adapted to snap into engagement with the opposite side edges of the stake for holding the clip on the stake and thereby holding the lower portion of the sheet metal form against the stake.

3. The combination as is recited in claim 2, wherein a notch is formed in each vertical side edge of the clip just above each ear in order to furnish each ear with spring resilience.

4. The combination as is recited in claim 3, wherein each upwardly-extending finger is formed with a tapered edge surface for engaging behind the lower edge of the said sheet metal form to create a resilient lever action for drawing the metal form against the side of the stake.

5. The combination as is recited in claim 2, wherein the said concave recess in the upper edge of the clip serves as a fulcrum edge working against the semi-circular shape of the main body of the stake as a support during the assembly of the clip to the stake so that the clip acts as a lever to first engage the two upwardly-extending fingers under and behind the lower edge of the said sheet metal form, and pressure is then applied against the lower portion of the clip to cause it to pivot on the said fulcrum edge until the said pair of ears snap around the opposite side edges of the stake.

* * * * *